US007965953B2

(12) United States Patent
Boyatt, III et al.

(10) Patent No.: US 7,965,953 B2
(45) Date of Patent: Jun. 21, 2011

(54) ELECTRODE-BASED POST NIP FIELD CONDITIONING METHOD AND APPARATUS

(75) Inventors: Richard Gordon Boyatt, III, Lexington, KY (US); Alexander Johannes Geyling, Lexington, KY (US); Brandon Alden Kemp, Lexington, KY (US); Niko Murrell, Lexington, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 61 days.

(21) Appl. No.: 12/485,130

(22) Filed: Jun. 16, 2009

(65) Prior Publication Data

US 2010/0316398 A1 Dec. 16, 2010

(51) Int. Cl.
*G03G 15/00* (2006.01)
*G03G 15/14* (2006.01)

(52) U.S. Cl. ..... 399/44; 399/315

(58) Field of Classification Search ..... 399/44, 399/66, 315

See application file for complete search history.

(56) References Cited

U.S. PATENT DOCUMENTS 4,782,358 A * 11/1988 Shibayama et al. ..... 399/315
5,253,023 A 10/1993 Hosaka et al.
5,708,932 A 1/1998 Yano et al.
5,822,650 A 10/1998 Noda et al.
6,134,407 A 10/2000 Ishiyama et al.
6,212,350 B1 4/2001 Yamada et al.
6,477,342 B2 11/2002 Komiya et al.
6,580,889 B1 6/2003 Ishiyama et al.
6,673,407 B2 1/2004 Hara et al.
6,912,370 B2 6/2005 Iwai
7,035,576 B2 4/2006 Kurosu
7,043,175 B2 5/2006 Komoto et al.
7,078,138 B2 7/2006 Asano et al.
7,155,150 B2 12/2006 Kurosu
7,233,765 B2 6/2007 Murai et al.
7,308,223 B2 12/2007 Kurosu
7,330,678 B2 2/2008 Kadowaki et al.
7,352,985 B2 4/2008 Tomizawa
7,378,212 B2 5/2008 Inagaki et al.
7,457,571 B2 11/2008 Azami
2008/0013969 A1 * 1/2008 Tomizawa ..... 399/44

OTHER PUBLICATIONS

Horrall, P. D. and Ream, G. L.; IBM Technical Disclosure Bulletin; vol. 3, No. 8 Jan. 1991.

* cited by examiner

*Primary Examiner* — Hoang Ngo

(57) ABSTRACT

An image-forming device includes a media path extending through the image-forming device, and at least one image transfer nip positioned along the media path. An electrode is positioned subsequent to the nip with respect to the media path and is coupled to a voltage source. An electric field produced by the electrode and voltage source limits the degree of post-nip toner scattering by applying an electrostatic force to toner particles on media sheets passing along the media path. The image-forming device further includes a processor for monitoring a plurality of ambient conditions, for adjusting the voltage applied to the electrode, and optionally, for repositioning the electrode with respect to the media path.

22 Claims, 7 Drawing Sheets

ELECTRODE-BASED POST NIP FIELD CONDITIONING METHOD AND APPARATUS

BACKGROUND OF THE INVENTION

1. Field of the Invention

The present invention relates to improvements in electrophotographic printing. More particularly, the present invention relates to improvements made to reduce or eliminate toner scattering during an electrophotographic printing process.

2. Background Art

During a non-impact image-forming process of an image-forming device, toner is transferred from toner-carrying members to the final image-bearing media. The non-impact nature of the image-forming process relies on differences in electrostatic charges to attract and draw the toner from the toner-carrying members to the media. However, once transferred to the media, errant electrostatic forces may disperse or scatter a portion of toner from the intended print area. Such dispersal may result in blurred or fuzzy areas surrounding the intended print area.

Given that different types of media may respond differently to electrostatic forces, toner scattering may occur differently based on media type. Moreover, electrostatic forces impact media differently based on the environmental conditions thereof. In general, toner scattering is an undesirable effect that affects print quality. Accordingly, improvements in electrophotographic printing are needed in order to control and minimize toner scattering to the greatest extent possible.

SUMMARY

An image-forming device includes a media path formed therethrough and including at least one transfer nip positioned along the media path. An electrode is positioned subsequent to the transfer nip with respect to the media path, and is coupled to a voltage source. An electric field produced by the electrode and voltage source limits the degree of post-nip toner scattering by applying an electrostatic force to toner particles on media sheets passing along the media path. The image-forming device further includes a processor for adjusting the voltage applied to the electrode, and for repositioning the electrode with respect to the media path.

BRIEF DESCRIPTION OF THE DRAWINGS

The features and advantages of the various exemplary approaches of this disclosure, and the manner of attaining them, will become more apparent and better understood by reference to the accompanying drawings, wherein.

DETAILED DESCRIPTION OF ILLUSTRATIVE EMBODIMENTS

Figure 1:
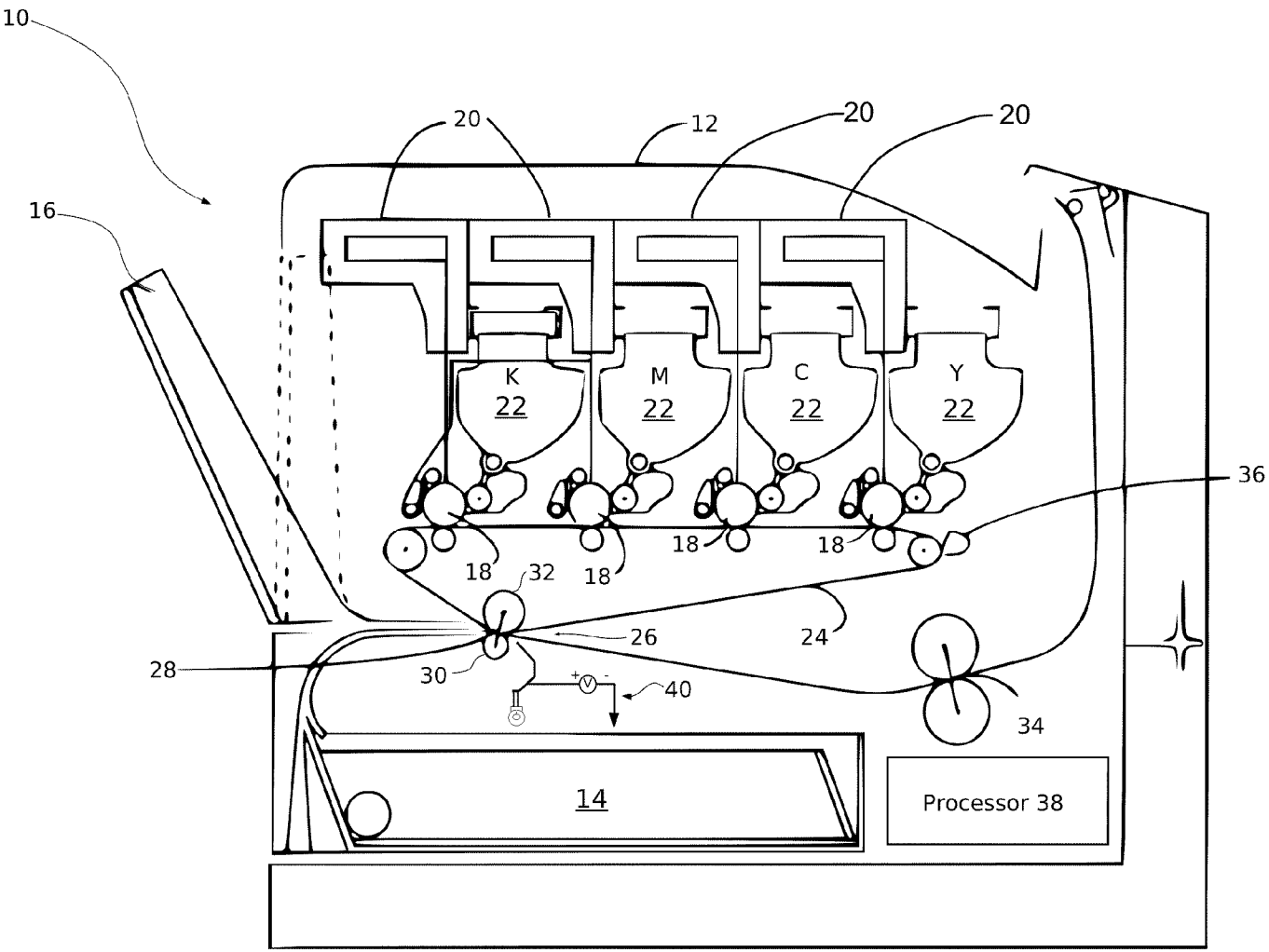
FIG. 1 is a system view of an exemplary image-forming device according to a selected illustrative embodiment of the invention.

It is to be understood that the following disclosure and claims are not limited in application to the details of construction and the arrangement of components set forth in the following description or illustrations. The disclosure is capable of other exemplary approaches and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings, but should be construed to include other connections such as electrical.

In addition, it should be understood that exemplary approaches described herein include both hardware and electronic components or modules that, for purposes of discussion, may be illustrated and described as if the majority of the components were implemented solely in hardware. However, one would recognize that, in at least one exemplary approach, some or all of the electronically-based aspects of the disclosure may be implemented in software. As such, it should be noted that a plurality of hardware and software-based devices, as well as a plurality of different structural components may be used to implement the exemplary approaches described herein. Furthermore, and as described in subsequent paragraphs, the specific mechanical configurations illustrated in the drawings merely provide exemplary approaches and that other alternative mechanical configurations are possible.

The electrostatic nature of the non-impact image-forming process allows for the influence and control of toner particles by applied electric fields. Accordingly, toner scattering is reduced or controlled in the practice of the present invention by conditioning any errant electrostatic forces with an applied electric field that is adapted to the type of media, to the toner used, and to the environmental conditions thereof.

FIG. 1 depicts an exemplary image-forming device 10 that has been supplemented with a conditioning apparatus 40. The term "image-forming device," and the like, is generally used herein as a device that produces images on printable media sheets. Examples include, but are not limited to, laser printers, LED printers, copy machines, etc. Commercially available examples of image-forming devices include Model Nos. C750 and C752 of Lexmark International, Inc. of Lexington, Ky.

The image-forming device 10 includes a main body 12 that houses media handling elements such as a media tray 14, a media sheet feeder 16, and various non-depicted belts and rollers. The main body 12 also houses imaging elements such as a plurality of photo-conductive drums 18, imaging devices 20, removable toner cartridges 22, an intermediate transfer belt 24, a secondary transfer point 26, a fuser 34, and a waste toner collector 36. The conditioning apparatus 40 may be positioned in an area upstream (with respect to the media handling path) of the fuser 34. As depicted, the conditioning apparatus 40 is positioned between the secondary transfer point 26 and the fuser 34.

The cartridges 22 include the same sub-elements and are only distinguished by the color of the toner contained therein. As depicted, the image-forming device 10 includes four cartridges 22, with colors black (K), magenta (M), Cyan (C), and yellow (Y). Each cartridge forms an individual mono-color image that is combined in a layered manner with images from the other cartridges to create the final multi-colored image. Each cartridge, which may be individually removable, includes a reservoir holding a supply of toner and a developer roller for applying toner to the respective photo-conductive drum 18. The photo-conductive drum 18 may be an aluminum hallow-core drum coated with one or more layers of light-sensitive organic photo-conductive materials. The drum 18 may be charged over its entire surface allowing for the imaging device 20 to discharge a portion of the surface with a laser beam, or the like. The discharged portion of the drum 18 corresponds to the image layer that will be printed with toner from the respective cartridge 22.

Toner is drawn by electrostatic force from the developer roll of the cartridge 22 to the discharged area of the drum 18. The endless intermediate transfer belt 24 rotates continuously in cooperation with the drums 18. A potential difference between the belt 24 and the drums 18 forces the toner particles from each of the drums onto the belt 24. The belt 24 and drums 18 are synchronized so that the toner from each drum precisely aligns to form the layered multi-colored image.

Media may be drawn from either the manual feeder 16 or the media tray 14 and delivered along the media path to the secondary transfer point 26. The timing of the media arrival is synchronized with the portion of the belt 24 carrying the completed image in order to transfer the toner from the belt to the media. At the secondary transfer point 26, the toner and the media move through an electric field at the exact point of transfer, or nip 28, created between a positively-biased second transfer roller 32 and a grounded backup roller 30. At the nip 28, the negatively charged toner particles become sandwiched between the belt 24 and the media. The electric field between the second transfer roller 32 and the backup roller 30 forces the toner to be released from the belt 24 and transferred onto the media. Subsequent to the toner transfer, the media passes through the fuser 34, which applies heat and pressure to permanently affix the toner to the media. A waste toner cleaner 36 removes any residual toner particles from the belt 24.

The above-described printing process may be controlled by a controller, such as a processor 38. While not depicted in detail, the processor 38 includes a processing unit and associated memory, and may be formed as one or more Application Specific Integrated Circuits (ASIC). The memory may be, for example, random access memory (RAM), read only memory (ROM), and/or non-volatile RAM (NVRAM). Alternatively, the memory may be in the form of a separate electronic memory (e.g., RAM, ROM, and/or NVRAM), a hard drive, a CD or DVD drive, or any memory device convenient for use with the processor 38. Regardless of the particular implementation, the memory provides a computer readable medium that may be encoded with computer instructions for controlling the processor 38 to carry out the printing process as well as the methods described below. The processor 38 may further include an I/O controller and I/O ports for communicating with an external computing or processing device. Moreover, computer instructions for implementing the image-forming process and the methods described herein may be provided to the device 10 via the I/O ports from a computer readable medium associated with the external processing device.

During operation of the image-forming device 10, the toner may partially scatter from the desired printing area of the media, prior to being permanently affixed thereto, due to erratic interactions between the electric field of the nip 28 and media and other device elements.

Figure 2:
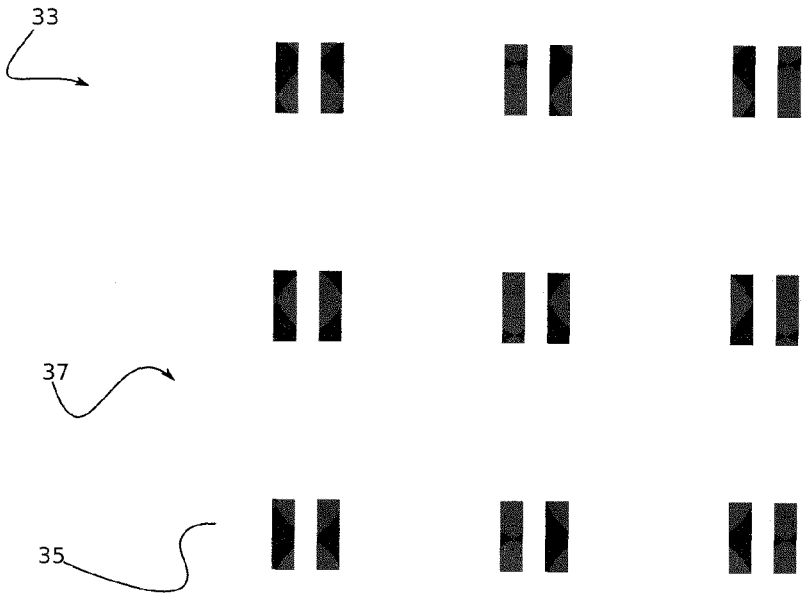
FIG. 2 is a partial view of an image printed from an image-forming device evidencing toner particle scattering.

FIG. 2 depicts an enlarged detail view of part of an exemplary image 33 produced by the image-forming device 10. The image 33 includes dark solid areas representing the desired print area 35, such as a printed letter or line. Scattered toner particles 37 may collect around the boundary of the desired print area 35. The scattered particles distort the boundary and thereby reduce the image quality. The device 10 operating environment, belt properties, roller characteristics, toner formulation, media properties, and other factors all influence toner transfer, scattering 37, and resulting image quality. Many of these factors directly impact the electric field strength at the nip 28.

Figure 3:
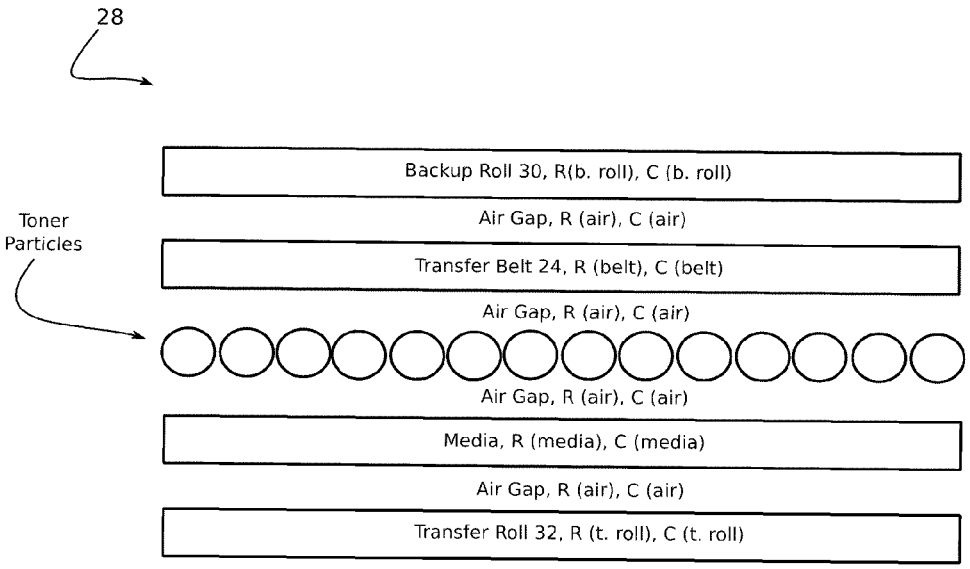
FIG. 3 is a diagrammatic depiction of the transfer nip of an image-forming device.

The schematic diagram of FIG. 3 depicts the exact transfer point, or nip 28, of the secondary transfer point 26. For efficient toner transfer to occur, a sufficient electric force must be applied to the toner while it is exposed to the electric field of the nip 28. Each layer of the depicted nip 28 has a combination of resistance and capacitance that influences how quickly the electric field develops. The device 10 maintains different time constants and nip electric field voltages for each combination of resistances and capacitances. For example, the processor 38 may alter the speeds of the rollers 30, 32 or the strength of the electric field to account for the resistance and capacitance combinations of the layers of the nip 28 at any given time.

However, the degree to which these variable inputs may be altered to accommodate the existing conditions is limited to a narrow range, due to the possibility of interfering with other aspects of the image-forming process. Accordingly, the secondary transfer point 26 typically only accommodates media and environmental conditions within a small range from the normal or desired operating environment.

For example, in a very dry environment, with the media being fully acclimated to such dry conditions, media resistance is notably higher than it is under normal conditions. The increased resistance drastically impacts the time constant of the secondary transfer point 26. Accordingly, it becomes difficult for the system to provide a sufficient potential while the media is present at the nip 28. Moreover, once the media exits the nip 28, the interactions of the negatively-charged toner particles become dominant. Specifically, the like charged particles repel each other, which results in scattering 37 (FIG. 2).

In general, excessively low voltages associated with the secondary transfer point 26 result in a greater degree of scattering 37 (FIG. 2). Increasing the voltage can reduce the degree of scattering 37. However, the limited amount of time that the media spends within the nip 28, and the electric field thereof, forecloses the possibility of entirely eliminating toner scattering 37. Additionally, scattered toner 37 may be influenced by errant electric fields caused by other components of the device 10, which may further distort the image.

Figure 4:
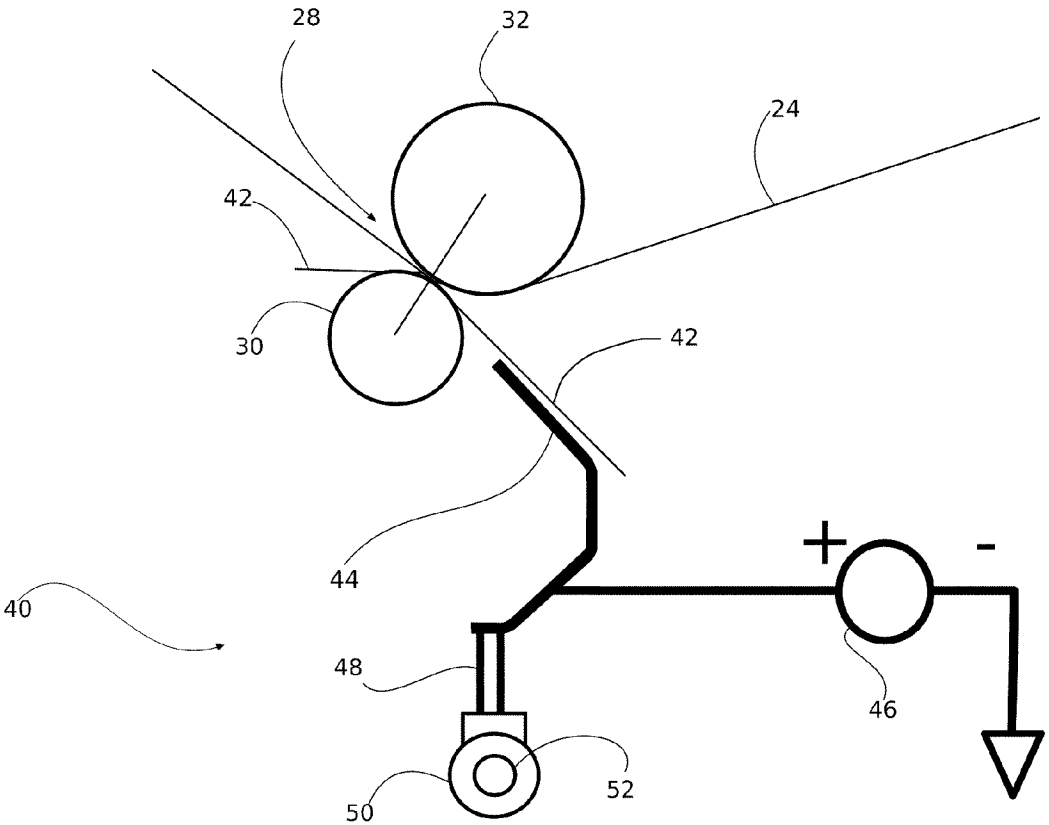
FIG. 4 is a partial end detail view of a conditioning apparatus according to a first illustrative embodiment hereof, in association with a secondary transfer point.

Without wishing to be bound by any theory, it is believed that toner scattering results from an insufficient electric field strength. In particular, media with a high resistance will be most likely to experience toner scattering. Accordingly, the image-forming device 10 according to the depicted embodiment of the invention is supplemented with a post-nip field conditioning apparatus 40. FIG. 4 depicts the conditioning apparatus 40 along with the elements of the secondary transfer point 26. As described above, the nip 28 provides a potential difference between the backup roller 30 and the secondary transfer roller 32, which forces the toner to transfer from the belt 24 to the media 42. The media 42 then continues post-nip to the fuser 34 (FIG. 1). The conditioning apparatus 40 may be positioned along the media path in order to reduce toner scattering that can occur post-transfer and prior to fusing, by beneficially influencing the electrostatic forces experienced by the media and the applied toner particles.

As depicted, the conditioning apparatus is positioned in a post-nip location between the secondary transfer point 26 and the fuser 34. However, it will be apparent that a mono-color image-forming device (not shown) may not include the secondary transfer point 26. For example, the nip may be directly between the photo-conductive drum 18 and the media such that toner transfers directly from the drum to the media. In such an image-forming device, the conditioning apparatus 40 hereof may still be positioned post-nip, e.g., along the media path immediately following the photo-conductive drum 18.

Moreover, there may be a plurality of conditioning apparatus 40 present in an image-forming device. For example, some multi-color printers may omit the secondary transfer belt 24 and sequentially apply each layer of toner directly to the media. In such a multi-nip device, it may be appropriate to position a conditioning apparatus 40 immediately after each nip.

Figure 5A:
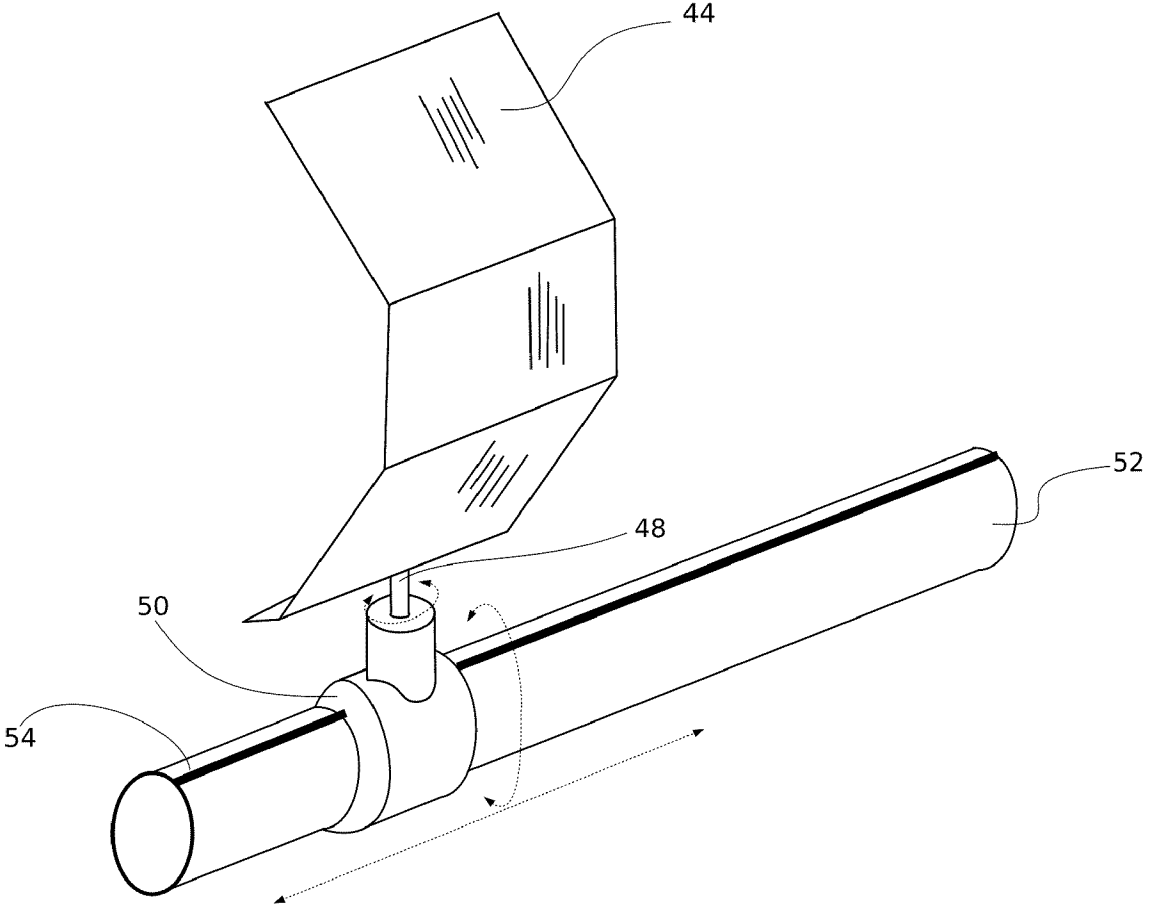
FIG. 5A is a partial perspective view of a conditioning apparatus and associated mounting elements according to a first illustrative embodiment.

The conditioning apparatus 40 may include an electrode 44 which is operatively coupled to a voltage source 46. The electrode 44 may be supported by one or more mounting elements 48, 50, 52, which will be discussed in greater detail with respect to FIG. 5A. Any electrode that produces an electric field strong enough to influence and maintain the adhesion of the toner particles to the media may be suitable for use in the conditioning apparatus 40. However, as depicted, the fin-shaped electrode 44, having a plurality of surfaces, may provide an electric field with a desirable arrangement of electric field lines. The electric field lines may emanate out of the surfaces of the electrode 44 to apply a force on the toner particles in particular directions. Specifically, the electric field produced by the electrode 44 may include electric field lines in a parallel direction, a perpendicular direction, and/or an oblique direction with respect to a plane of the media sheet on the media path.

While the electrode 44 is shown having a substantially shell-shaped or C-shaped cross-section in the drawings, that shape is shown only for purposes of illustration and not limitation. Those in the art will understand that the electrode may be formed in virtually any shape which will be functional, and which will fit inside of the image-forming device 10 without interfering with the other components.

In one exemplary approach, the voltage source 46 may provide a constant voltage that causes the electrode to produce an electric field that is suitable for a predetermined media type and operating environment. The predetermined media type and operating environment may represent ideal conditions, or the most common conditions that are typically experienced by the image-forming device 10. The applied voltage may cause the electrode to maintain a similar potential to that present in the nip 28, or a substantially different potential to that present in the nip. The electrode 44 may even be grounded in some circumstances. However, in another exemplary approach, the voltage source 46 may provide a variable voltage that is controllable or selectable. For example, the processor 38 may control the voltage source 46 to alter the voltage applied to the electrode 44 based on various factors, e.g., the type of media, the image being printed, the environmental conditions, etc.

The processor 38 may be configured to cause the voltage source 46 to apply a higher voltage to the electrode 44 in drier conditions, as well as for media with a high degree of resistance. Similarly, humid conditions and media with a greater degree of conductivity may not require as much voltage as dry or highly resistive media. The processor 38 may determine the environmental conditions such as humidity and temperature from sensors (not shown), or the like.

The processor 38 may further account for the degree to which the media is acclimated to the environmental conditions. For example, media that was recently loaded into the image-forming device may be less acclimated than media that has been stored in the device for some time. Accordingly, in one exemplary approach, the length of time that the media has been exposed to the environmental conditions of the device 10 may be used to determine the degree of acclimation thereto. The appropriate voltage will be based on the electrical properties of the media and the determined environmental conditions. As discussed above, a larger voltage will be needed to create an electric field with a sufficient force to maintain the adhesion of the toner particles to a highly resistant media sheet.

As discussed above, it may be desirable for the electric field produced by the electrode 44 to include electric field lines in a parallel direction, a perpendicular direction, and/or an oblique direction with respect to a plane of the media sheet on the media path. In one exemplary approach, the position and orientation of the electrode may be fixed with respect to the media path. In such an approach, the direction of the electric field lines may be controlled by the orientation of the surface(s) of the electrode 44. The electrode may be fixedly positioned to accommodate the most likely media and printing orientations.

However, in another exemplary approach, the electrode may be repositioned within the image-forming device 10. Moreover, the electrode 44 may be repositioned on a per-sheet basis to account for various media attributes, e.g., the size of the media, print orientation on the media, etc. FIGS. 4 and 5 depict the electrode mounted on a plurality of cooperative mounting elements 48, 50, 52. Any number of mounting configurations may be appropriate. The depicted mounting elements 48, 50, and 52, represent merely one exemplary approach that provides a wide range of mobility for the electrode 44.

Optionally, a rotable support 48 may be attached to the electrode 44. The rotable support may be attached to a truck 50. A rotable shaft 52 positioned perpendicularly with respect to the media path may support the truck 50. Accordingly, the rotable shaft 52 may rotated about its longitudinal axis, the truck 50 may slide back-and-forth along the longitudinal axis of the shaft 52, and the rotable support 48 may rotate about the truck. Dashed lines in FIG. 5 identify the range of movement provided by the exemplary approach. Specific control means, e.g., gears, motors, belts, etc., are omitted for simplicity of illustration. Additionally, a controller (not shown), may selectively reposition the support elements 48, 50, 52 to position the electrode 44 in a specific orientation with respect to the media path. Moreover, the controller may reposition the electrode 44 on a per-sheet basis. In one exemplary approach, the processor 38 may control the positions of the support elements 48, 50, 52.

Figure 5B:
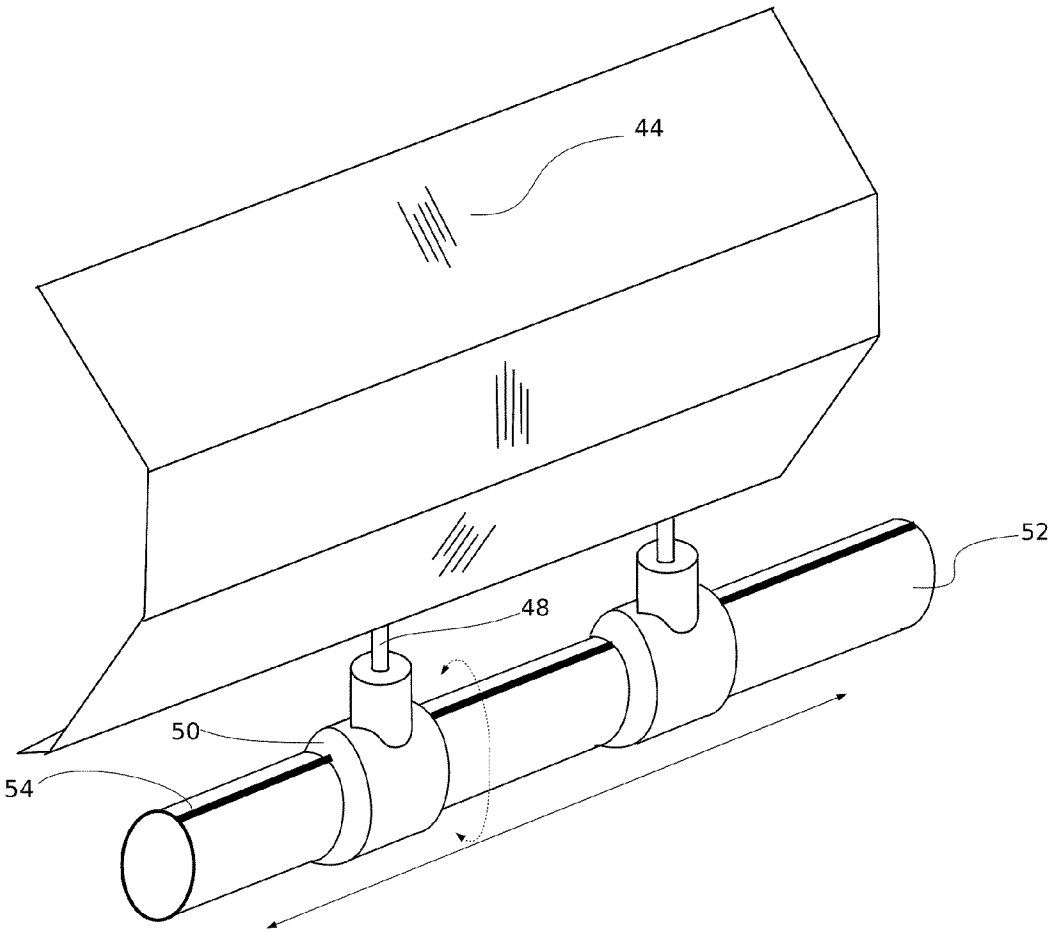
FIG. 5B is a partial perspective view of a conditioning apparatus and associated mounting elements according to a second illustrative embodiment.
Figure 5C:
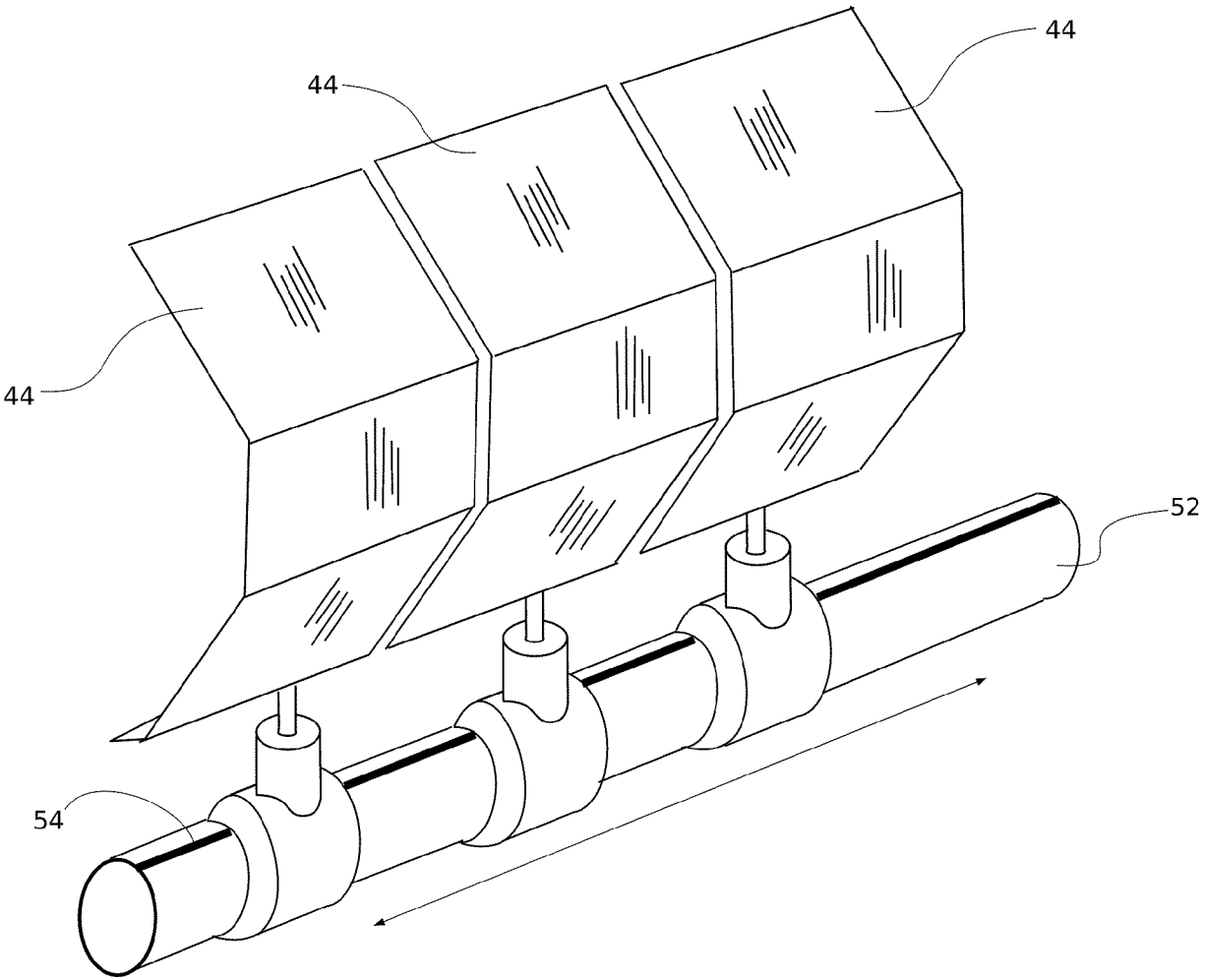
FIG. 5C is a partial perspective view of a conditioning apparatus and associated mounting elements according to a third illustrative embodiment.

Alternative variations of the electrode 44 are shown in FIGS. 5B and 5C. In FIG. 5B, the width of the electrode 44 is increased so that it is substantially as wide as the roller with which it is associated. In FIG. 5C, a plurality of side-by-side electrodes are used to provide a compound electrode having a combined width that it is substantially as wide as the roller with which it is associated.

Figure 6:
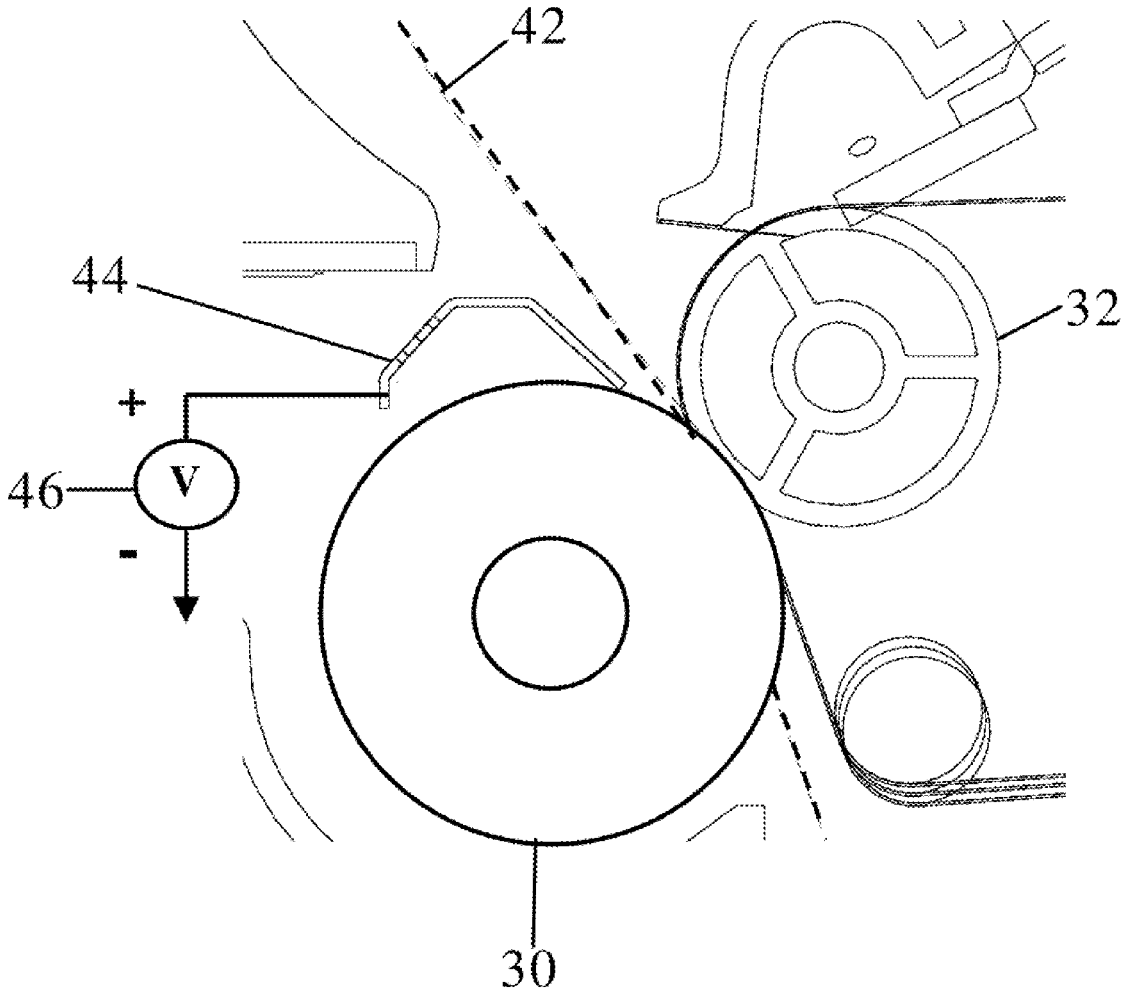
FIG. 6 is a partial end detail view of a conditioning apparatus according to a second illustrative embodiment hereof, in association with a secondary transfer point.

Another embodiment of the invention showing a possible alternate physical arrangement of the electrode 44 is shown in FIG. 6, using similar numbers to those used in FIG. 4, where appropriate.

Accordingly, it will be understood that in the practice of the present invention, a conditioning apparatus 40 may be added to an image-forming device 10, in order to reduce post-nip toner particle scattering. The conditioning apparatus 40 may include an electrode 44 coupled to a voltage source 46. Applying a voltage from the voltage source 46 to the electrode 44 produces an electric field. The electric field exerts an electrostatic force on the toner particles that have been deposited onto the media traveling along the media path. The force limits the degree of toner scattering while the media transits to the fuser 34. The electrode 44 may be fixedly attached or repositionable within the image-forming device 10. Additionally, the strength of the electric field, as determined by the voltage applied to the electrode 44, may be static to account for the most common operating and media conditions, or variable to account for the specific operating and media conditions present on a per-sheet basis.

The foregoing description of methods and exemplary approaches has been presented for purposes of illustration. It is not intended to be exhaustive or to limit the below-listed claims to the precise steps and/or forms disclosed, and obviously many modifications and variations are possible in light of the above teaching. It is intended that the scope of the disclosure be defined by the claims appended hereto.

The invention claimed is:

1. A conditioning apparatus for an image-forming device, comprising:

at least one electrode positioned subsequent to a nip of the image forming device with respect to a media path, an electric field produced by the electrode including electric field lines emanating therefrom in one of a parallel direction, a perpendicular direction and an oblique direction with respect to a plane of the media sheet on the media path; and a voltage source coupled to the electrode.

2. The conditioning apparatus according to claim 1, further comprising at least one electric field producing surface associated with the at least one electrode.

3. The conditioning apparatus according to claim 1, further comprising at least one mounting element supporting the at least one electrode in a position adjacent to the media path.

4. A conditioning apparatus for an image-forming device, comprising:

an electrode positioned subsequent to a nip of the image-forming device with respect to a media path;

a voltage source coupled to the electrode; and a plurality of operable mounting elements supporting the at least on electrode within the image-forming device and a controller configured to selectively reposition the at least one electrode by adjusting the orientation of the mounting elements.

5. The conditioning apparatus according to claim 1, further comprising a processor configured to:

determine a resistance of a media sheet within an image-forming device; and determine a voltage to be generated by the voltage source, based on the resistance of the media sheet.

6. The conditioning apparatus according to claim 5, wherein the processor is further configured to account for at least one environmental condition present in the image-forming device when determining the resistance.

7. An image-forming device, comprising:

a media path through the image-forming device;

at least one nip positioned along the media path;

at least one electrode positioned subsequent to a nip of the image forming device with respect to the media path; and a voltage source coupled to the at least one electrode, the voltage source and the electrode generating an electric field adjacent to the media path, the electric field including electric field lines emanating from the at least one electrode in at least one of a parallel direction, a perpendicular direction and an oblique direction with respect to a plane of a media sheet on the media path.

8. The image-forming device according to claim 7, further comprising a processor configured to:

determine a resistance of the media sheet within an image-forming device; and determine a voltage to be generated by the voltage source, based on the resistance of the media sheet.

9. The image-forming device according to claim 8, wherein the processor is further configured to account for at least one environmental condition present in the image-forming device when determining the resistance.

10. The image-forming device according to claim 7, wherein the at least one nip is positioned between a photoconductive drum and the media sheet.

11. The image-forming device according to claim 7, wherein the at least one nip is positioned between an intermediate transfer belt and the media sheet at a secondary transfer point.

12. The image-forming device according to claim 7, further comprising at least one mounting element supporting the at least one electrode in a position adjacent to the media path.

13. An image-forming device, comprising:

a media path through the image-forming device;

at least one nip positioned along the media path;

at least one electrode positioned subsequent to the at least one nip with respect to the media path;

a voltage source coupled to the at least one electrode, the voltage source and the electrode generating an electric field adjacent to the media path; and a plurality of operable mounting elements supporting the at least one electrode and a controller configured to selectively reposition the at least one electrode by adjusting the orientation of the mounting elements.

14. The image-forming device of claim 13, wherein the at least one electrode is selectively rotated about a first axis by the controller by adjusting the orientation of the mounting elements.

15. The image-forming device of claim 14, wherein the at least one electrode is repositioned by the controller by adjusting the orientation of the mounting elements by at least one of rotating the at least one electrode about a second axis different from the first axis, translating the at least one electrode along the first axis, and translating the at least one electrode about an axis different from the first axis.

16. A method for affecting post-nip toner particle scattering, said method comprising:

determining a resistance of a media sheet within an image-forming device;

determining a voltage based on the resistance of the media sheet;

applying the voltage to an electrode positioned subsequent to a nip of the image-forming device with respect to a media path, application of the voltage to the electrode, producing an electrostatic force to act upon the toner particles; and directing an electric field produced by the electrode adjacent to the media path, the electric field including electric field lines emanating from the electrode in at least one of a parallel direction, a perpendicular direction and an oblique direction with respect to a plane of the media sheet on the media path.

17. The method according to claim 16, further comprising calculating the resistance in terms of conductance.

18. The method according to claim 16, further comprising accounting for at least one environmental condition present in the image-forming device when determining the resistance.

19. The method according to claim 18, further comprising accounting for the degree to which the media sheet is acclimated to the at least one environmental condition when determining the resistance.

20. The method according to claim 16, further comprising altering the position of the electrode such that the electric field lines associated with the electric field extend in at least one of the parallel direction, the perpendicular direction, and the oblique direction with respect to the plane of the media sheet.

21. The method according to claim 20, wherein altering the position of the electrode comprises rotating the position of the electrode along a first axis.

22. The method according to claim 21, wherein altering the position of the electrode further comprises at least one of rotating the position of the electrode along a second axis different from the first axis, translating the electrode along the first axis, and translating the electrode along a different axis from the first axis.

* * * * *